US006243906B1

(12) United States Patent
Holliday et al.

(10) Patent No.: US 6,243,906 B1
(45) Date of Patent: Jun. 12, 2001

(54) ICE SCRAPER ASSEMBLY

(75) Inventors: Brian Holliday, Danbury; Jeffrey Kapec, Westport; Kazuna Tanaka, Cos Cob, all of CT (US); Pazit Vider Kagel, New York, NY (US)

(73) Assignee: Prestone Products Corporation, Danbury, CT (US)

( * ) Notice: Subject to any disclaimer, the term of this patent is extended or adjusted under 35 U.S.C. 154(b) by 0 days.

(21) Appl. No.: 09/236,692

(22) Filed: Jan. 25, 1999

(51) Int. Cl.[7] ..... A47L 1/06; A47L 13/02

(52) U.S. Cl. ..... 15/111; 15/236.02; 15/236.06; 15/236.08; 30/172; D4/118; D32/49

(58) Field of Search ..... 15/105, 111, 117, 15/236.01, 236.02, 236.05, 236.06, 263.08; 30/172; D4/118; D32/46, 49

(56) References Cited

U.S. PATENT DOCUMENTS

| | | | | |
|---|---|---|---|---|
| D. 294,416 | | 2/1988 | Carroll | D32/48 |
| D. 313,881 | | 1/1991 | Nielson | D32/46 |
| D. 336,783 | | 6/1993 | Hopkins et al. | D4/118 |
| D. 337,436 | | 7/1993 | Hopkins | D4/118 |
| D. 338,298 | | 8/1993 | Grims, Sr. | D32/45 |
| D. 355,529 | | 2/1995 | Tsai | D4/118 |
| D. 366,738 | | 1/1996 | Israel | D32/42 |
| D. 373,863 | | 9/1996 | Shepherd | D32/42 |
| D. 383,267 | | 9/1997 | Emmerth | D32/46 |
| 532,564 | * | 1/1895 | Kelley | 15/236.06 |
| 1,085,063 | * | 1/1914 | Prouty et al. | 15/236.05 |
| 1,204,764 | * | 11/1916 | Helmich | 15/236.05 |
| 1,233,673 | | 7/1917 | Kinney | 294/51 |
| 1,377,484 | * | 5/1921 | Huneryager | 30/132 |
| 1,813,604 | * | 7/1931 | Berge | 15/236.05 |
| 2,236,093 | * | 3/1941 | Friend | 15/236.06 |
| 2,253,116 | * | 8/1941 | Findlay | 15/236.05 |
| 2,364,333 | * | 12/1944 | Wisher | 15/236.05 |
| 2,449,092 | * | 9/1948 | Struble | 30/132 |
| 2,633,594 | * | 4/1953 | Robbins | 15/236.06 |
| 2,639,454 | | 5/1953 | Dory | 15/245 |
| 2,699,614 | | 1/1955 | Welch | 37/229 |
| 2,770,826 | * | 11/1956 | Curfman | 15/236.02 |
| 2,856,621 | * | 10/1958 | Racicot | 15/111 |
| 3,051,975 | * | 9/1962 | Schwartz | 15/111 |

(List continued on next page.)

*Primary Examiner*—Mark Spisich
(74) *Attorney, Agent, or Firm*—Frommer Lawrence & Haug; Edgar H. Haug, Esq.; Matthew K. Ryan, Esq.

(57) ABSTRACT

A combination ice scraper and snow removal assembly which has multiple blades in contact with the working/windshield surface to more efficiently remove ice and snow therefrom and reduce the amount of energy expended by the user to scrape and remove snow from the working surface. This combination ice scraper and snow removal assembly includes a main body portion having two ends thereof. A scraping assembly is provided at one end of the main body for scraping a frozen water material from a working surface. The scraping assembly includes at least three scraping blades with at least one of the scraping blades having a continuous blade edge and at least two of the scraping blades having toothed cutting edges. As a result, in a single swiping or scraping action of the user, ice or snow can be dislodged from the working windshield/surface by the scraping blade assembly and then cleared and/or removed from that dislodged location by the cleaning blade removal assembly in a limited path of travel.

21 Claims, 4 Drawing Sheets

U.S. PATENT DOCUMENTS

| | | | | |
|---|---|---|---|---|
| 3,408,677 | | 11/1968 | Yates | 15/236.02 |
| 3,787,921 | * | 1/1974 | Feldmann | 15/105 |
| 4,086,699 | * | 5/1978 | Olkkola | 30/172 |
| 4,155,142 | * | 5/1979 | Demetriadis | 15/236.06 |
| 4,304,024 | | 12/1981 | Branscheid et al. | 15/105 |
| 4,404,705 | | 9/1983 | Thoma | 15/313 |
| 4,546,513 | | 10/1985 | Hammond | 15/105 |
| 4,662,947 | | 5/1987 | Hopkins | 134/6 |
| 4,683,592 | | 8/1987 | Strongwater | 2/17 |
| 4,712,269 | | 12/1987 | Worthen | 15/236.02 |
| 4,719,660 | | 1/1988 | Hopkins | 15/105 |
| 4,742,595 | * | 5/1988 | Isaacs | 15/105 |
| 4,747,175 | | 5/1988 | Durgin | 15/105 |
| 4,770,712 | | 9/1988 | Hopkins | 134/6 |
| 4,813,458 | | 3/1989 | Jacobucci | 15/236.02 |
| 4,870,712 | | 10/1989 | Markus | 15/227 |
| 4,922,569 | | 5/1990 | Brinker et al. | 15/105 |
| 4,930,176 | | 6/1990 | Gelman | 15/4 |
| 4,962,561 | | 10/1990 | Hamilton | 15/111 |
| 5,033,156 | * | 7/1991 | Stewart | 15/236.05 |
| 5,077,856 | * | 1/1992 | Freundl | 15/111 |
| 5,099,540 | | 3/1992 | Paschetto | 15/236.02 |
| 5,179,754 | | 1/1993 | Stradnick | 15/105 |
| 5,255,406 | * | 10/1993 | Rood | 15/236.06 |
| 5,263,222 | | 11/1993 | Johnstone, II | 15/236.02 |
| 5,287,593 | | 2/1994 | Sprunger | 15/401 |
| 5,333,342 | | 8/1994 | Huang | 15/105 |
| 5,349,716 | * | 9/1994 | Millar | 15/236.06 |
| 5,357,646 | | 10/1994 | Kim | 15/111 |
| 5,418,998 | | 5/1995 | Smarra | 15/105 |
| 5,539,949 | * | 7/1996 | Stanton | 15/117 |
| 5,680,668 | | 10/1997 | Kim | 15/236.02 |
| 5,810,856 | * | 9/1998 | Tveras | 15/111 |
| 5,829,143 | * | 11/1998 | Gilliam | 30/172 |
| 6,018,836 | * | 2/2000 | Isaacs | 15/105 |

* cited by examiner

ICE SCRAPER ASSEMBLY

FIELD OF THE INVENTION

The present invention relates to an ice scraper assembly, and more particularly, to an ice scraper assembly which is used to remove ice and snow from vehicle windshields and windows and has multiple blades in contact with the working surface to more efficiently remove the ice and snow therefrom.

BACKGROUND OF THE INVENTION

Hand-held plastic scrapers for scraping ice and snow from the windshield of a vehicle are well-known. Typically, such scrapers include a single beveled scraping blade which extends from a handle portion thereof. In use, the user grasps the handle and scrapes the ice and snow from the windshield with the scraping blade. However, in inclement, cold conditions, the less physical exertion expended by the user, the better. In addition, the faster the ice and snow are removed, the faster the user can get out of the inclement conditions. Therefore, various prior ice scrapers have been designed to reduce the amount of energy expended by the user to remove snow and ice from the automobile windshield or to reduce the time necessary to scrape ice and snow from the vehicle.

In an attempt to reduce the amount of energy expended by the user, prior art ice scrapers have employed multiple blades on a single scraper. Representative examples include U.S. Pat. No. 4,719,660 issued Jan. 19, 1988 to Hopkins, U.S. Pat. No. 5,263,222 issued Nov. 23, 1993 to Johnstone, II, U.S. Pat. No. 5,099,540 issued Mar. 31, 1992 to Paschetto, and U.S. Design Pat. No. 294,416 issued Feb. 23, 1998 to Carroll. In the ice scraper of U.S. Pat. No. 4,719,660, a scraping blade extends from one end of the scraper which includes dual outwardly flared scraping arms. However, in the ice scraper of the '660 patent only one of the scraping arms (either the scraping edge or the shovel/squeegee edge) can be used at a time. Therefore, the energy expended by the user to utilize the ice scrapers of the '660 patent is the same as that of a single edge scraper.

In the ice scraper of U.S. Design Pat. No. 294,416, a dual removable blade assembly is employed wherein an upper blade assembly can apparently be removably secured to a lower blade assembly. However, a user must expend the same amount of energy utilizing the ice scraper of U.S. Design Pat. No. 294,416 as it appears that the blades of the upper and lower blade assemblies thereof would not simultaneously contact the windshield surface in a single scraping or cleaning action.

The ice scraper of U.S. Pat. No. 5,263,222 employs front and rear scraper blades which are positioned on opposite ends of the handle portion. However, the ice scraper of U.S. Pat. No. 5,263,222 is primarily concerned with providing added comfort to the user as the handle portion is supported by the blades positioned on opposite sides thereof. Notwithstanding that purported advantage, placing the blades on opposite sides of the handle requires more exertion by the user, as in order to benefit from the dual scraping design, the user must swipe a path which is more than the considerable distance between the two blades. Moreover, the two blades of the ice scraper of U.S. Pat. No. 5,263,222 only perform scraping action and thus this ice scraper does not provide an adequate cleaning blade assembly for removing the ice or snow after it has been scraped off the working surface of the vehicle or does not adhere to the vehicle working surface.

Although the ice scraper of U.S. Pat. No. 5,099,540 has multiple scraping surfaces, only a single scraping edge is provided on each side thereof. Therefore, for each scraping motion of the user, only one scraping edge is performing a scraping operation. In addition, the ice scraper of U.S. Pat. No. 5,099,540 does not include a blade assembly which acts as a squeegee. Accordingly, even if snow or ice is removed, partly or totally, from the vehicle windshield, it cannot be further removed as it will not be contacted again by another scraping edge.

OBJECTS OF THE INVENTION

Therefore, it is an object of the present invention to provide a combination ice scraper and snow removal assembly which avoids the aforementioned disadvantages of the prior art.

An additional object of the present invention is to provide a combination ice scraper and snow removal assembly which has multiple blades in contact with the working/windshield surface t o more efficiently remove ice and snow therefrom.

Another object of the present invention is to provide a combination ice scraper and snow removal assembly which reduces the amount of energy expended by the user to scrape and remove ice and snow from the working surface.

An additional object of the present invention is to provide a combination ice scraper and snow removal assembly which reduces the time necessary to scrape and remove ice and snow from the working surface.

A further object of the present invention is to provide a combination ice scraper and snow removal assembly which includes a scraping blade assembly on one end of the handle portion which both face the working surface.

A still further object of the present invention is to provide a combination ice scraper and snow removal assembly wherein after the snow or ice has been partly or totally removed from the working surface, that dislodged ice or snow will again come in contact with another scraping blade to assist in further removing the ice or snow from the working/vehicle surface.

A yet still further object of the present invention is to provide a combination ice scraper and snow removal assembly which is designed to fracture and pulverize ice more efficiently.

Yet another object of the present invention is to provide a combination ice scraper and snow removal assembly which is ergonomically designed for ease of use.

Various other objects, advantages and features of the present invention will become readily apparent from the ensuing detailed description and the novel features will be particularly pointed out in the appended claims.

SUMMARY OF THE INVENTION

In accordance with the present invention, a combination ice scraper and snow removal assembly is provided which reduces the amount of energy expended by the user to scrape and remove ice and snow from the working/windshield surface. This ice scraper and snow removal assembly includes a generally cylindrical main body portion having a brush-like member extending from one end thereof for removing ice and snow from the working surface. A scraping assembly is provided at the other end of the main body portion for scraping the ice and snow from the working surface.

This scraping assembly includes a toothed edge blade assembly and a cleaning blade removal assembly provided on the same end of the main body portion which both face the working surface. As a result, in a single swiping or scraping action of the user, the ice or snow can be dislodged from the working/windshield surface by the toothed edge blade assembly and then cleared and/or removed from that dislodged location by the cleaning blade removal assembly in a limited path of travel.

This scraping assembly includes at least three scraping blades with at least two of the scraping blades simultaneously contacting the working surface when the main body portion is at a predetermined angular orientation with respect to the working surface. Moreover, the cutting configuration of the scraping blades is designed to fracture and pulverize ice more efficiently. As a result, the ice, and snow is more efficiently removed from the working surface, and accordingly, less energy need be expended by the user to scrape and remove ice and snow from the working surface. In addition, less time is required to remove ice and snow from the working surface.

More particularly, a first blade of three scraping blades includes a continuous blade edge to provide a cleaning blade action for removing previously dislodged or non-adhered ice and snow from the working surface upon scraping or swiping action applied by the user to the main body portion. This continuous blade edge is positioned the most inwardly of the three scraping blades toward the main body portion. The other two scraping blades of the scraping assembly include toothed cutting edges for initially scraping ice and snow from the working surface. In order to provide a continuous scraping path generally perpendicular to the direction of scraping action, the toothed cutting edges of these two scraping blades are offset relative to one another. Further, these two scraping blades having toothed cutting edges include grooved openings formed between the toothed cutting edges with the grooved openings of these two scraping blades-being as well offset relative to one another. The two scraping blades of the scraping assembly having the toothed cutting edges are positioned outwardly from the main body portion with respect to the first blade having a continuous blade edge.

Therefore, in a single swiping action, the two blades having toothed cutting edges provide a continuous scraping path generally perpendicular to the direction of scraping action to thereby partially or completely dislodge ice or snow adhered to the working surface in that path of movement. In that same scraping action, the continuous blade edge provides a cleaning blade action for clearing or removing the previously dislodged or non-adhered ice and snow from the working surface in that same path of movement.

In one preferred embodiment of the combination ice scraper and snow removal assembly of the present invention, a plastic cap member is fitted over the main body portion at the end thereof opposite to the scraping assembly which is ergonomically designed to provide for easy palm pushing action.

BRIEF DESCRIPTION OF THE DRAWINGS

The following detailed description, given by way of example, will best be understood in conjunction with the accompanying drawings in which.

DETAILED DESCRIPTION OF CERTAIN PREFERRED EMBODIMENTS

Figure 1:
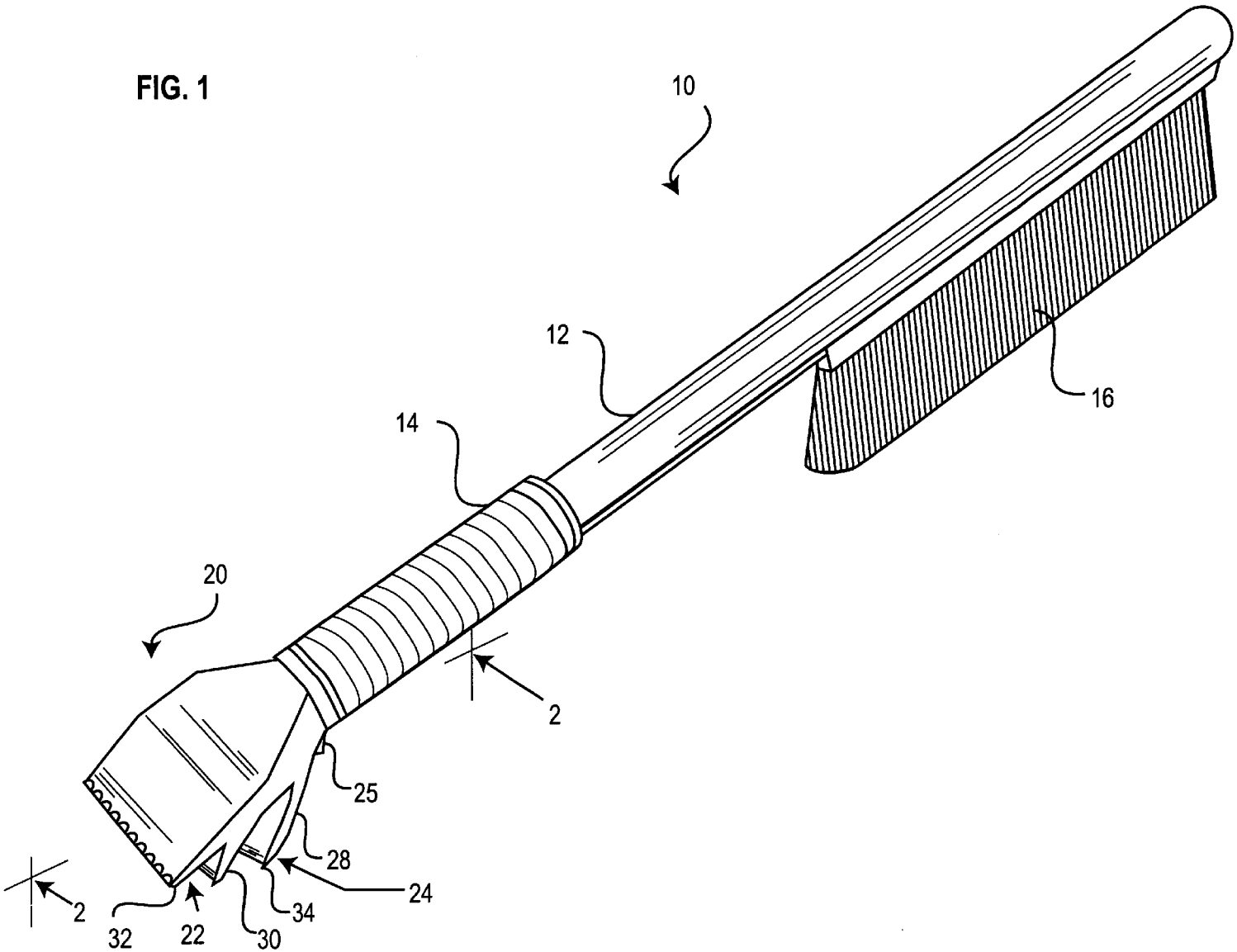
FIG. 1 is a front perspective view of a preferred embodiment of a combination ice scraper and snow removal assembly in accordance with the teachings of the present invention.

Referring now to the drawings, wherein like reference numerals are used throughout and in particular to FIG. 1, there is illustrated a preferred embodiment of a combination ice scraper and snow removal assembly in accordance with the present invention. This ice scraper and snow removal assembly reduces the amount of energy expended by the user to scrape and remove ice and snow from a working surface, such as a window or a windshield of an automobile. In addition, less time is required to remove ice and snow from a working surface by utilizing this ice scraper and snow removal assembly as it more efficiently breaks and pulverizes ice and snow from the working surface.

As is shown in FIG. 1, this ice scraper and snow removal assembly 10 includes a main body portion 12 which can be grasped by the user for scraping or swiping action. In order for the user to comfortably grasp this ice scraper and snow removal assembly, the main body portion 12 includes a handle member 14 made of a foam-like material.

A brush-like member 16 extends from one end of the main body portion 12 of the ice and snow removal assembly for removing previously dislodged ice and snow from the working surface. A scraping assembly 20 is provided at the other end of the main body portion 12 for scraping ice and snow from a working/windshield surface.

This scraping assembly includes a toothed edge blade assembly 22 and a cleaning blade removal assembly 24 provided on the same end 25 of the main body portion with both facing the working surface. As a result, in a single swiping or scraping action of the user, the snow or ice can be dislodged from the working/windshield surface by the toothed edge blade assembly 22 and then further cleared and/or removed from that dislodged location by the cleaning blade removal assembly 24 in a limited path of travel.

More particularly, this scraping assembly 20 includes at least three scraper blades 28, 30 and 32 with at least two of the scraper blades simultaneously contacting the working surface when the main body portion is at a predetermined angular orientation with respect to the working surface as will be discussed in further detail below. As a result, the ice and snow is more efficiently removed from the working surface, and accordingly, less energy need be expended by the user to scrape and remove ice and snow from the working surface.

Figure 2:
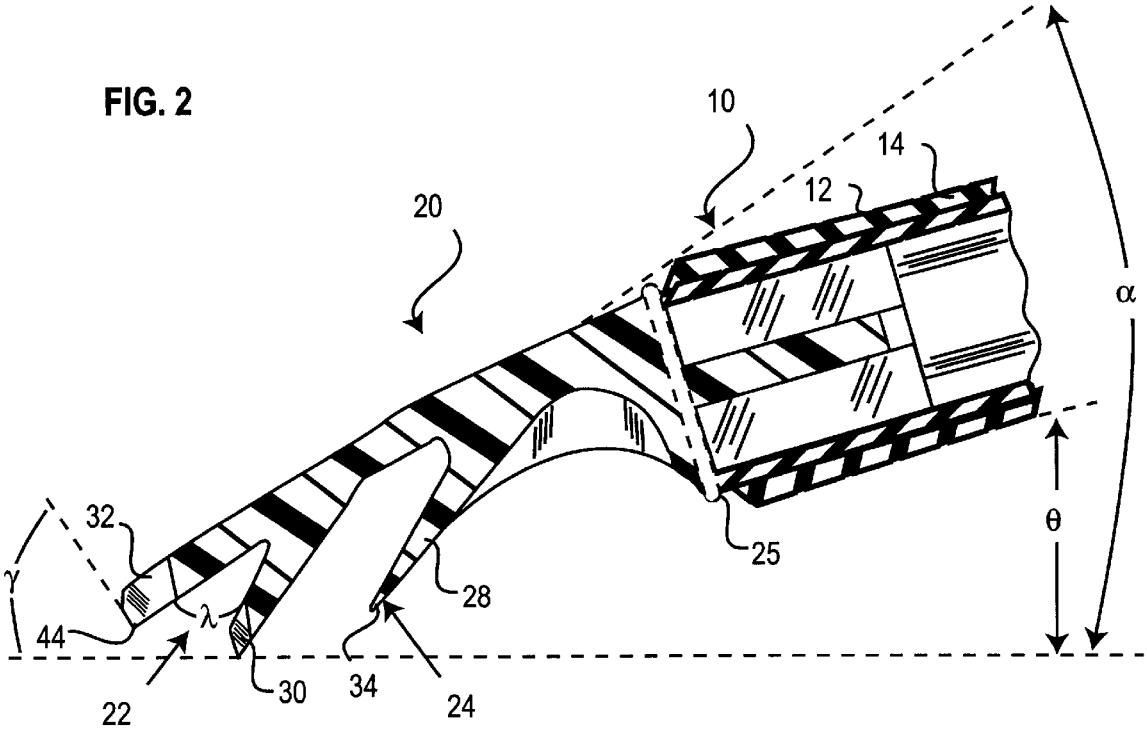
FIG. 2 is an enlarged front cross-sectional view of a scraping assembly provided at one end of the combination ice scraper and snow removal assembly of FIG. 1 taken along line 2—2 thereof.
Figure 3:
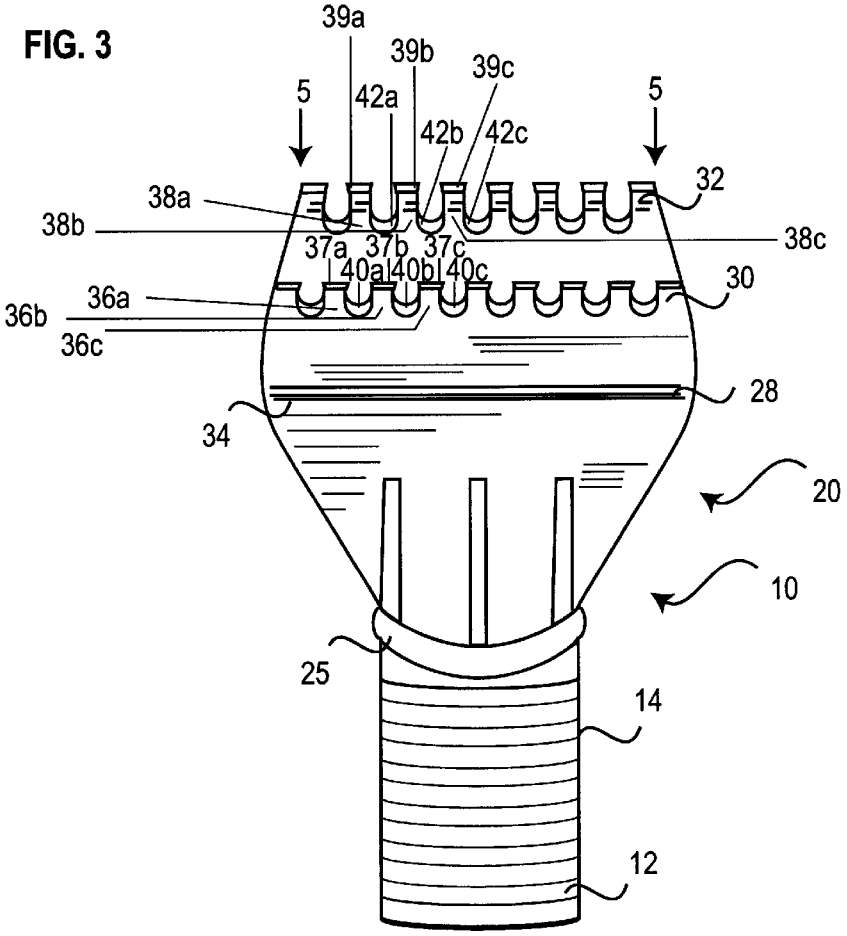
FIG. 3 is a bottom plan view of the scraping assembly of FIG. 2.

As is shown in FIGS. 2 and 3, the first blade 28 of the three scraping blades forms the cleaning blade removal assembly 24 and includes a continuous cleaning blade edge 34 to provide a cleaning action for removing previously dislodged or non-adhered ice and snow from the working surface upon scraping or swiping action applied by the user to the main body portion. As is thus shown in FIG. 2, the scraping blade 28 including the continuous cleaning blade edge 34 is positioned the most inwardly of the three blades 28, 30 and 32 toward the main body portion 12. As is represented by the angle α in FIG. 2, the continuous blade edge 34 of the first blade 28 is at an angular orientation of approximately 48° to the working surface when the predetermined angular orientation of the main body portion 12 to the working surface is approximately 15° (see angle θ in FIG. 2).

Figure 4:
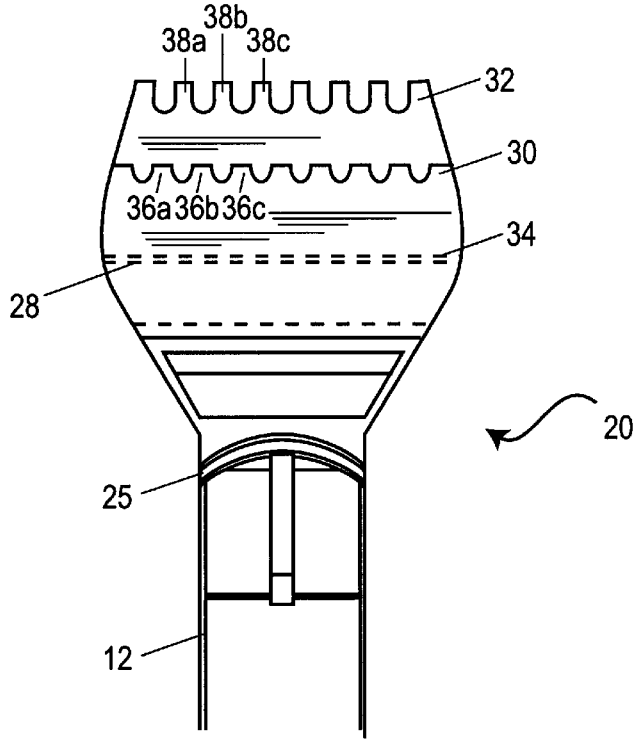
FIG. 4 is a top plan view of the scraping assembly of FIG. 2.
Figure 5:
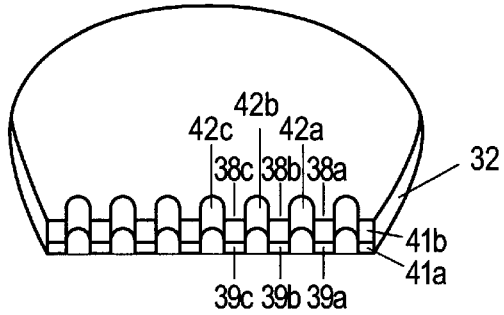
FIG. 5 is a side plan view of the scraping assembly of FIG. 2 taken along line 5—5 of FIG. 3.
Figure 6:
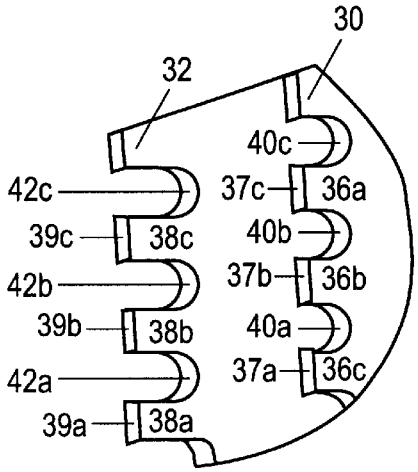
FIG. 6 is an enlarged bottom plan view specifically illustrating the toothed cutting edges of two blades of the scraping assembly of FIG. 2 being offset relative to one another.

The other two scraping blades 30, 32 of the scraping assembly form the toothed edge blade assembly and include respective toothed cutting edges for initially scraping ice and snow from the working surface. Specifically, the second blade 30 includes toothed cutting portions, such as 36*a*, 36*b* and 36*c*, and the third blade 32 includes toothed cutting portions, such as 38*a*, 38*b* and 38*c*, as best shown in FIGS. 3, 4 and 6. In order to provide a continuous scraping path generally perpendicular to the direction of scraping action, the toothed cutting portions 36*a*, 36*b* and 36*c* of the second blade 30 are offset relative to the toothed cutting portions 38*a*, 38*b* and 38*c* of the third blade 32. In addition, the toothed cutting portions 36*a*, 36*b* and 36*c* of the second blade 30 include toothed cutting edges, such as 37*a*, 37*b* and 37*c*, which have a predetermined angle. As such, the toothed cutting edges form an angle generally normal to the working surface while the ice scraper is being used in its desired position. Moreover, the toothed cutting portions 38*a*, 38*b* and 38*c* of the third blade 32 include toothed cutting edges, such as, 39*a*, 39*b* and 39*c*, which may have a number of beveled regions, such as 41*a*, 41*b* (see FIG. 5), arranged at predetermined angles.

Further, these two scraping blades 30 and 32 having toothed cutting edges include grooved openings formed between the toothed cutting edges. As shown in FIGS. 3, 4 and 6, grooved openings 40*a*, 40*b* and 40*c* are formed between the toothed cutting portions 36*a*, 36*b* and 36*c* of the second blade 30. Similarly, grooved openings 42*a*, 42*b* and 42*c* are formed between the toothed cutting portions 38*a*, 38*b* and 38*c* of the third blade 32. A s is shown in FIGS. 5 and 6, the grooved openings 40*a*, 40*b* and 40*c* of the second blade 30 are offset as well from the grooved openings 42*a*, 42*b* and 42*c* of the third blade 32. These two scraping blades 30 and 32 having the toothed cutting edges are positioned outwardly from the main body portion 12 with respect to the first blade 28 having the continuous cleaning blade edge 34.

In accordance with one of the general objects of the present invention, the cutting configuration of the scraping assembly is designed to fracture and pulverize ice more efficiently. In order to achieve this result, the distances between toothed cutting portions 36*a–c* and 38*a–c* with their respective toothed cutting edges 37*a–c* and 39*a–c* and the grooved openings 40*a–c* and 42*a–c* are of a predetermined ratio such that the points of contact of the toothed cutting edges more efficiently fractures and pulverizes ice and snow.

Moreover, as is shown in FIG. 2, the second and third blades 30 and 32 are angularly displaced at an angle of approximately 6° relative to one another as is represented by the angle λ in FIG. 2. Moreover, when the third blade 32 contacts the working surface, the forward edge 44 of the third blade 32 is angularly displaced with respect to the working surface at an angular orientation of approximately 70° as represented by angle γ in FIG. 2.

Therefore, in a single swiping action, the two blades 30 and 32 having the toothed cutting edges provide a continuous scraping path generally perpendicular to the direction of scraping action to thereby partially or completely dislodge ice or snow adhered to the working surface in that path of movement. In the same scraping action, the continuous cleaning blade edge 34 provides a cleaning action for further cleaning and/or removing the previously dislodged or non-adhered ice and snow from the working surface in that same path of movement.

Figure 7:
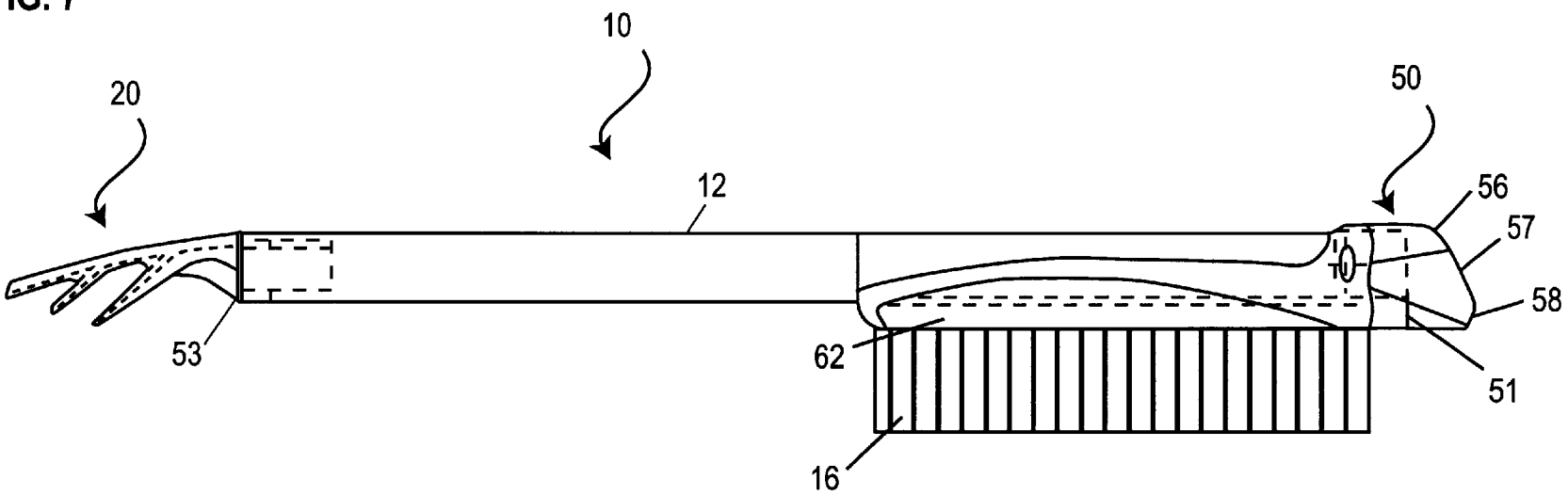
FIG. 7 is a side elevational view of another preferred embodiment of a combination ice scraper and snow removal assembly in accordance with the teachings of the present invention.
Figure 8:
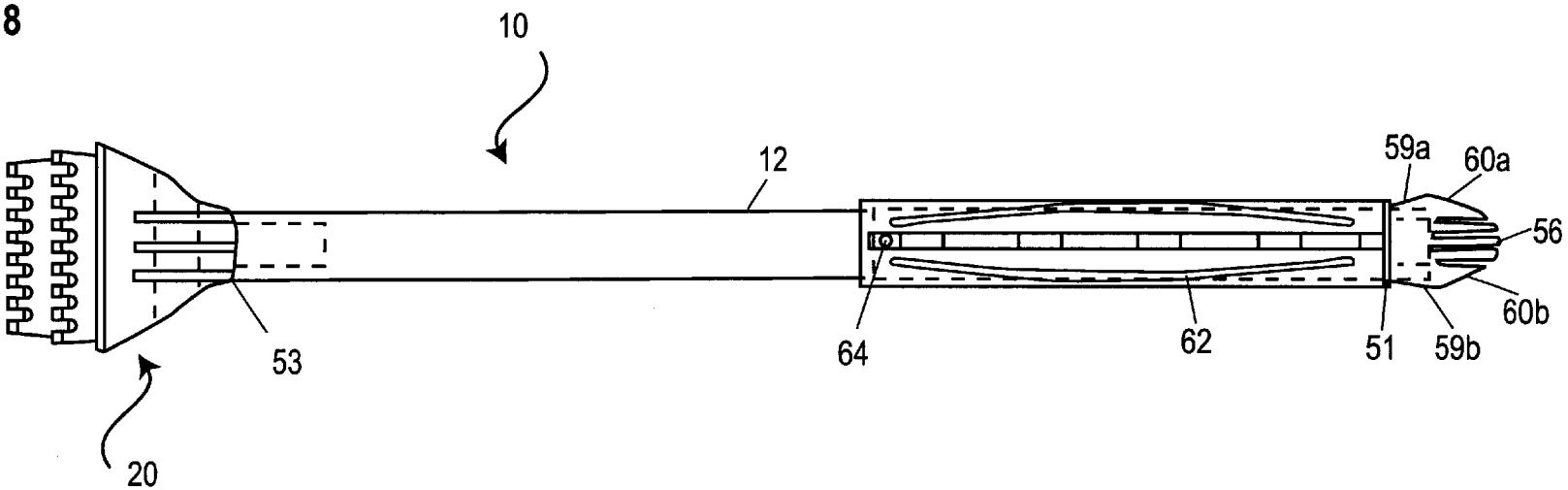
FIG. 8 is a top plan view of the combination ice scraper and snow removal assembly of FIG. 7.

In order to provide for palm point pushing control of the ice scraper assembly, a plastic cap member 50 can be fitted over the end 51 of the main body portion 12 which is opposite to end 53 supporting the scraping assembly 20 (see FIGS. 7–8). This plastic cap member 50 is ergonomically designed to allow for such palm point pushing control. For instance, the rear face 56 of the cap member 50 has a downwardly inclined surface 57 terminating in a bulbous tip 58 designed to fit in the palm. In addition, the cap member 50 has specifically designed indentations 59*a* and 59*b* along the respective side edges 60*a* and 60*b* thereof to provide for further palm or finger point pushing control.

As is shown in FIGS. 7–8, the brush member 16 may also be supported along the main body portion 12 by means of a carriage 62 secured thereto with the aid of fastening member 64.

Based upon the foregoing, it will be appreciated that a combination ice scraper and snow removal assembly has been designed which has multiple blades in contact with the working/windshield surface to more efficiently remove the ice and snow therefrom and reduce the amount of energy expended by the user to scrape and remove ice and snow from the working surface. In addition, this ice scraper and snow removal assembly reduces the amount of time expended by the user to remove ice and snow from the working surface. Further, the ice scraper and snow removal assembly of the present invention includes a toothed edge blade assembly and a cleaning blade removal assembly provided on one end of the handle portion which both face the working surface. Moreover, with this ice scraper and snow removal assembly, after snow or ice has been partially or totally removed from the working surface, that dislodged ice or snow will again come in contact with another scraping blade to assist in further removing the ice or snow from the working/vehicle surface.

While the present invention has been particularly shown and described with reference to a preferred embodiment, it would be readily apparent to those of ordinary skill in the art that various changes and modifications may be made therein without departing from the spirit and scope of the invention. For instance, a shorter version of the ice scraper and snow removal assembly of the present invention is also envisioned wherein the main body portion is shortened with only the scraping assembly 20 extending from one end thereof. It is intended that the appended claims be interpreted as including the foregoing as well as various other such changes and modifications.

What is claimed is:

1. A combination ice scraper and snow removal assembly comprising:

a main body portion having two ends thereof;

scraping means provided at one end of said main body portion for scraping a frozen water material from a working surface, said scraping means including at least three parallelly-arranged scraping blades with a first scraping blade having a continuous blade edge and a second and a third scraping blade having toothed cutting edges wherein at least two of said scraping blades are simultaneously useable, and wherein the toothed cutting edges of the second and third blades are adapted for scraping the frozen water material with the toothed cutting edges of said second scraping blade being laterally offset from and not aligned with the toothed cutting edges of said third scraping blade.

2. The combination ice scraper and snow removal assembly of claim 1 wherein said continuous blade edge is adapted to remove non-adhered frozen water material from the working surface upon scraping or swiping action applied by the user to the main body portion.

3. The combination ice scraper and snow removal assembly of claim 2 wherein said continuous blade edge is at an angular orientation of approximately 48° to the working surface when the predetermined angular orientation of the main body portion to the working surface is approximately 15°.

4. The combination ice scraper and snow removal assembly of claim 2 wherein said first scraping blade having said continuous blade edge is positioned the most inwardly toward said main body portion of said at least three scraping blades.

5. The combination ice scraper and snow removal assembly of claim 1 wherein said two scraping blades having toothed cutting edges have grooved openings formed between said toothed cutting edges with said grooved openings of said second blade being offset from the grooved openings of said third blade.

6. The combination ice scraper and snow removal assembly of claim 1 wherein said two scraping blades having toothed cutting edges are angularly displaced at an angle of approximately 6° relative to one another.

7. The combination ice scraper and snow removal assembly of claim 1 wherein said two scraping blades having toothed cutting edges are positioned outwardly from the main body portion with respect to the first scraping blade having a continuous blade edge.

8. The combination ice scraper and snow removal assembly of claim 1 and further comprising brush removal means for removing a frozen water material from a working surface provided at the other end of said main body portion.

9. The combination ice scraper and snow removal assembly of claim 1 wherein a plastic cap member is provided at another end of said main body portion which is ergonomically designed to provide palm point pushing control of the assembly.

10. A combination ice scraper and snow removal assembly comprising:

a main body portion having two ends thereof;

brush means for removing a frozen water material from a working surface provided at one end of said main body portion;

scraping means provided at the other end of said main body portion for scraping a frozen water material from the working surface, said scraping means including at least three parallelly-arranged scraping blades wherein a first blade of said scraping blades includes a continuous blade edge for initially removing non-adhered frozen water material from the working surface upon scraping or swiping action applied by the user to the main body portion and second and third blades of said at least three scraping blades include toothed cutting edges for scraping the frozen water material from the working surface with the toothed cutting edges of said second blade being laterally offset and not aligned with the toothed cutting edges of said third blade.

11. The combination ice scraper and snow removal assembly of claim 10 wherein at least two of said first, second and third blades simultaneously contact the working surface when the main body portion is at a predetermined angular orientation with respect to the working surface.

12. The combination ice scraper and snow removal assembly of claim 11 wherein said continuous blade edge of said first blade is at an angular orientation of approximately 48° to the working surface when the predetermined angular orientation of the main body portion to the working surface is approximately 15°.

13. The combination ice scraper and snow removal assembly of claim 11 wherein said second and third blades are angularly displaced at an angle of approximately 6° relative to one another.

14. The combination ice scraper and snow removal assembly of claim 10 wherein said second and third blades have grooved openings formed between said toothed cutting edges with said grooved openings of said second blade being offset from the grooved openings of said third blade.

15. The combination ice scraper and snow removal assembly of claim 10 wherein a plastic cap member is provided at said one end of said main body portion which is ergonomically designed to provide palm point pushing control of the assembly.

16. A combination ice scraper and snow removal assembly comprising:

a main body portion having two ends thereof;

removal means for removing a frozen water material from a working surface provided at one end of said main body portion; and scraping means provided at the other end of said main body portion for scraping a frozen water material from a working surface, said scraping means having a blade assembly formed of at least three parallelly-arranged blade surfaces including a first blade surface being formed of a continuous blade edge for initially removing non-adhered frozen water material from the working surface upon scraping or swiping action applied by the user to the main body portion and second and third blade surfaces including toothed cutting edges for scraping the frozen material from the working surface and wherein at least two of said blade surfaces are simultaneously useable; and wherein the toothed cutting edges of the second and third blade surfaces are adapted for scraping the frozen water material with the toothed cutting edges of said second blade surface being laterally offset from and not aligned with the toothed cutting edges of said third blade surface.

17. The combination ice scraper and snow removal assembly of claim 16 wherein said continuous blade edge is at an angular orientation of approximately 48° to the working surface when the predetermined angular orientation of the main body portion to the working surface is approximately 15°.

18. The combination ice scraper and snow removal assembly of claim 16 wherein said second and third toothed blade surfaces are angularly displaced at an angle of approximately 6° relative to one another.

19. The combination ice scraper and snow removal assembly of claim 16 wherein said second and third toothed blade surfaces have grooved openings formed between said toothed cutting edges with said grooved openings of said second and third toothed blade surfaces being offset relative to one another.

20. The combination ice scraper and snow removal assembly of claim 16 wherein said removal means is a brush-like member.

21. The combination ice scraper and snow removal assembly of claim 16 wherein a plastic cap member is provided at said one end of said main body portion which is ergonomically designed to provide palm point pushing control of the assembly.

* * * * *